US008259984B2

(12) United States Patent
van der Bilt

(10) Patent No.: US 8,259,984 B2
(45) Date of Patent: Sep. 4, 2012

(54) HEADSET WITH ON-EAR DETECTION

(75) Inventor: Casper van der Bilt, Emmen (NL)

(73) Assignee: Sony Ericsson Mobile Communications AB, Lund (SE)

( * ) Notice: Subject to any disclaimer, the term of this patent is extended or adjusted under 35 U.S.C. 154(b) by 1256 days.

(21) Appl. No.: 11/770,840

(22) Filed: Jun. 29, 2007

(65) Prior Publication Data

US 2009/0003641 A1 Jan. 1, 2009

(51) Int. Cl.
*H04R 25/00* (2006.01)

(52) U.S. Cl. ..... 381/374; 381/334; 381/384; 381/380; 381/74

(58) Field of Classification Search ..... 381/374, 381/334, 384, 74, 380, 370, 330, 331
See application file for complete search history.

(56) References Cited

U.S. PATENT DOCUMENTS

2006/0045304 A1* 3/2006 Lee et al. ..... 381/384
2006/0233413 A1 10/2006 Nam
2007/0147629 A1* 6/2007 Chiloyan ..... 381/74
2007/0274530 A1 11/2007 Buil et al.
2008/0077620 A1* 3/2008 Gilley et al. ..... 707/104.1

FOREIGN PATENT DOCUMENTS

WO 2007/049255 5/2007

OTHER PUBLICATIONS

International Preliminary Report on Patentability for corresponding International Application No. PCT/IB2007/004064, dated Sep. 3, 2009.
International Search Report and Written Opinion for corresponding Application No. PCT/IB2007/004064 dated Jul. 2, 2008.

* cited by examiner

*Primary Examiner* — Vivian Chin
*Assistant Examiner* — Paul Kim
(74) *Attorney, Agent, or Firm* — Renner, Otto, Boisselle & Sklar, LLP

(57) ABSTRACT

A headset including a body configured to be affixed to an ear of a user, and a speaker for reproducing an audio signal, the speaker representing part of the body such that when the body is affixed to the ear, the speaker is positioned proximate the ear canal of the user. The headset further includes at least one sensor for producing an output indicative of whether the body is affixed to the ear. In addition, the headset includes an analyzer, operatively coupled to the at least one sensor, for analyzing whether the body is affixed to the ear based on the output of the at least one sensor.

19 Claims, 6 Drawing Sheets

EXEMPLARY RULES (ON EAR DETECTON):

a) AT LEAST TWO OF B1-B4, AT LEAST TWO OF I1-I6 AND AT LEAST TWO OF O1-O5 b) AT LEAST TWO OF B1-B4, AT LEAST TWO OF I4-I6, O3-O5, AND AT LEAST TWO OF I1-I3, O1-O2 c) AT LEAT ONE OF B1-B4, AT LEAST ONE OF I4-I6, O3-O5, AND AT LEAST ONE OF I1-I3, O1-O2 d) ETC.

FIG. 5

LEARNED PROFILES (ON EAR DETECTION):

PROFILE 1 (BOB): B1, B3, B4, I1, I2, I5, O2, O3, O5

PROFILE 2 (SALLY): B2, B3, I2, I4, I5, 01, 02, O5

PROFLE 3 (FRED): B2, B3, B4, I1, I2, 13, I6, O1, O5

ETC.

FIG. 6

HEADSET WITH ON-EAR DETECTION

TECHNICAL FIELD OF THE INVENTION

The present invention relates generally to communications headsets, and particularly to headsets for use with portable electronic devices and the like.

DESCRIPTION OF THE RELATED ART

Portable electronic devices have been popular for decades yet continue to increase in popularity. Many modern portable electronic devices are intended or suitable for recording or playback of acoustic and/or video signals. For example, portable CD or DVD players, MPEG players, MP-3 players, etc. provide a vast variety of forms of personal entertainment. Whether audio and/or video entertainment, there are numerous portable electronic devices to satisfy any user's tastes.

Similarly, portable electronic devices in the form of mobile phones, pagers, communicators, e.g., electronic organizers, personal digital assistants (PDAs), smartphones or the like are also becoming increasingly popular. Such devices allow a user to communicate with others, store and manipulate data, create text, etc., many times within the same device.

Depending on the particular application(s) a given portable electronic device performs, oftentimes one or more accessories are used in combination with the portable electronic device. Examples of such accessories include hands-free headsets. These headsets typically include one or more loudspeakers for reproducing audio in the ear(s) of the user. In addition, the headsets oftentime include a microphone for obtaining audio signal (e.g., voice) from the user. With such a headset, the user of a mobile phone or other portable electronic device can enjoy hands-free operation when carrying on phone conversations, listening to various media such as audio and/or audio-video files, etc. The headsets may be connected to the portable electronic device via an electrical cord or via a wireless connection.

The functionality of headsets has continued to increase over the years. For example, headsets are now capable of controlling operation of the portable electronic device, and vice versa. As a specific example, headsets today may include a Bluetooth or other wireless interface for connecting to the portable electronic device. In the case of a mobile phone, the headset may be used to initiate a call, answer a call, hang up, etc. In the case of a media player, the headset may interact with the device to control the volume, initiate and stop playback, etc. The functionality of the headset is determined based on a combination of hardware and software, allowing considerable flexibility in the operation and utility of the headset.

In view of the increased utility of hands-free headsets, there is an ongoing need for maintaining simplicity of operation of the headset from the perspective of the user.

SUMMARY

According to the present invention, a headset is provided including a body configured to be affixed to an ear of a user, and a speaker for reproducing an audio signal, the speaker representing part of the body such that when the body is affixed to the ear, the speaker is positioned proximate the ear canal of the user. The headset further includes at least one sensor for producing an output indicative of whether the body is affixed to the ear. In addition, the headset includes an analyzer, operatively coupled to the at least one sensor, for analyzing whether the body is affixed to the ear based on the output of the at least one sensor.

According to one particular aspect, the headset further includes a controller for controlling operation of the headset based on an output of the analyzer.

According to another aspect, the at least one sensor includes a plurality of sensors positioned at different locations on the body.

In accordance with another aspect, the speaker is located in a bud portion of the body designed to be inserted in the concha when affixed to the ear, and the at least one sensor is located on the bud portion to detect when the bud portion has been inserted in the concha.

With yet another aspect, the at least one sensor includes a plurality of sensors positioned at different locations on the bud portion.

According to still another aspect, the body includes a semicircular portion configured to wrap around the pinna when affixing the body to the ear.

Still further, according to another aspect the at least one sensor includes a plurality of sensors positioned at different locations along the semicircular portion.

In accordance with still another aspect, the semicircular portion includes a fixed end and a distal end, and the plurality of sensors include sensors located proximate the fixed end and sensors located proximate the distal end.

With still another aspect, the at least one sensor includes a plurality of sensors, and the analyzer analyzes the output of each of the sensors according to at least one predefined rule to determine whether the body is affixed to the ear.

According to another aspect, the at least one predefined rule requires that the outputs of all of the sensors indicate that the body is affixed to the ear.

According to still another aspect, the plurality of sensors are represented by subsets, and the at least one predefined rule requires at least one of the sensors in each subset indicate that the body is affixed to the ear.

In accordance with another aspect, the body includes a semicircular portion configured to wrap around the pinna when affixing the body to the ear, the semicircular portion includes a fixed end and a distal end, and the plurality of sensors include a first subset of sensors located proximate the fixed end and a second subset of sensors located proximate the distal end.

According to another aspect, the body includes a semicircular portion configured to wrap around the pinna when affixing the body to the ear, the semicircular portion includes an inner side which faces the skull of the user and an outer side which faces the ear flap of the user when the body is affixed to the ear, and the plurality of sensors include a first subset of sensors located on the inner side and a second subset of sensors located on the outer side.

In accordance with still another aspect, the at least one sensor includes a plurality of sensors positioned at different locations on the body, the analyzer includes a learning function configured to detect the output of each of the sensors while the body is affixed to the ear of the user, and to store the outputs in memory so as to represent a profile for the user. The analyzer subsequently analyzes whether the body is affixed to the ear of the user based on a comparison of the outputs of each of the sensors with the profile stored in memory.

With still another aspect, the analyzer learns and stores the profiles of each of a plurality of different users, and the analyzer subsequently analyzes whether the body is affixed to the ear of a user, and if so, to which user, based on a comparison of the outputs of each of the sensors and the profiles stored in memory.

According to yet another aspect, the headset further includes a processor for controlling operation of the headset based on an output of the analyzer, at least one aspect of the control being a function of the particular user's ear to which the analyzer determines the body to be affixed.

According to another aspect, the at least one aspect of the control includes one or more user specific operation preferences.

In accordance with another aspect, the headset includes at least one of a wireless transceiver interface or a hardwire interface for connecting the headset to a source of the audio signal.

With yet another aspect, the headset further includes a microphone for producing a voice signal from the user.

According to another aspect, the at least one sensor comprises at least one of a capacitive sensor, optical sensor or mechanical sensor.

To the accomplishment of the foregoing and related ends, the invention, then, comprises the features hereinafter fully described and particularly pointed out in the claims. The following description and the annexed drawings set forth in detail certain illustrative embodiments of the invention. These embodiments are indicative, however, of but a few of the various ways in which the principles of the invention may be employed. Other objects, advantages and novel features of the invention will become apparent from the following detailed description of the invention when considered in conjunction with the drawings.

It should be emphasized that the term "comprises/comprising" when used in this specification is taken to specify the presence of stated features, integers, steps or components but does not preclude the presence or addition of one or more other features, integers, steps, components or groups thereof.

BRIEF DESCRIPTION OF THE DRAWINGS

FIG. 5 illustrates exemplary rules for determining whether the headset is presently on-ear in accordance with an exemplary embodiment of the present invention;

FIG. 6 illustrates exemplary profiles for determining whether the headset is presently on-ear in accordance with an exemplary embodiment of the present invention;

DETAILED DESCRIPTION OF EMBODIMENTS

Figure 1:
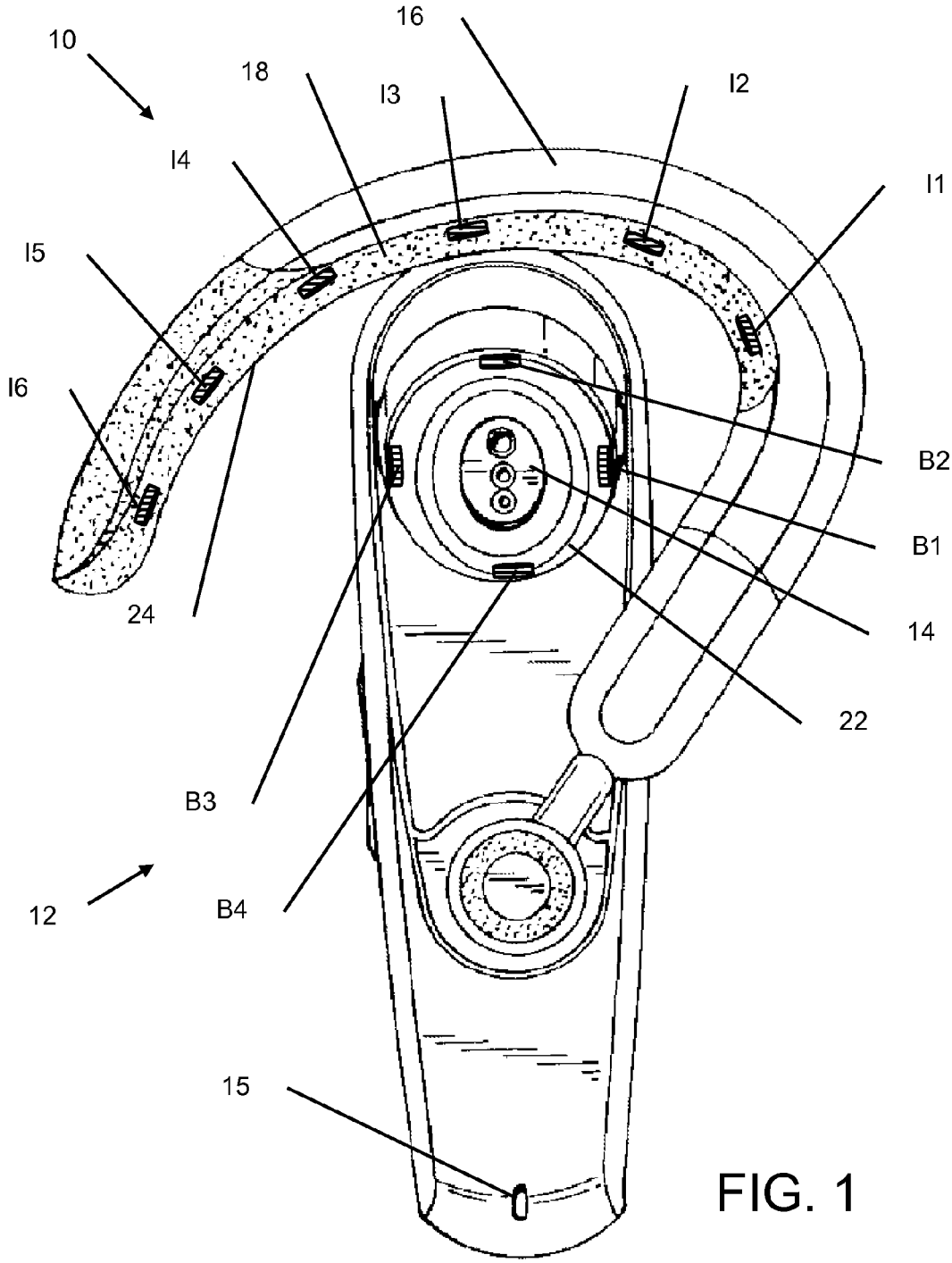
FIG. 1 is a front view of a headset with on-ear detection in accordance with an exemplary embodiment of the present invention.

The present invention will now be described with reference to the drawings, wherein like reference numerals refer to like elements throughout.

In accordance with the present invention, a headset is provided that offers both enhanced functionality and/or ease of use for the user. Depending upon the particular type of headset, intended use, etc., it may be desirable to know when the headset is mounted or affixed to the ear(s) of the user. For example, in the case of a Bluetooth headset it is necessary to establish a wireless connection with the mobile phone or other portable electronic device. By detecting when the headset has been affixed to the ear of the user, the headset may identify itself as an available Bluetooth device. As another example, the headset may operate in a "standard" mode and a low-power "sleep" mode. By detecting when the headset has been affixed to the ear of the user, the headset may awaken from the "sleep" mode to the "standard" mode.

As still another example, the use of the headset may necessitate the portable device to reconfigure itself and/or utilize various application software. For instance, the user of a portable media player may wish to use different audio equalization settings when using the headset as compared to when using speakers included in the player itself. By detecting when the headset is affixed to the ear of the user, the media player may be prompted automatically to reconfigure the equalization settings to those associated with the headset.

Still further, the headset of the present invention is capable of recognizing the particular user to whose ear the headset is attached. By distinguishing between particular users, the headset and/or portable electronic device may configure itself automatically to the particular settings, preferences, etc. associated with the particular user. As a particular example, a first user of the headset may prefer audio equalization settings of a first arrangement, whereas a second user may prefer audio equalization settings of a second arrangement different from the first. By automatically reconfiguring the headset and/or portable electronic device based on detecting the particular user, use of the headset is further facilitated.

As will be appreciated, the headset of the present invention has utility in any number of scenarios in which it is useful to detect automatically when the headset is affixed to the ear of the user. The headset of the present invention in its broadest sense is not limited to use in any particular context.

Figure 2:
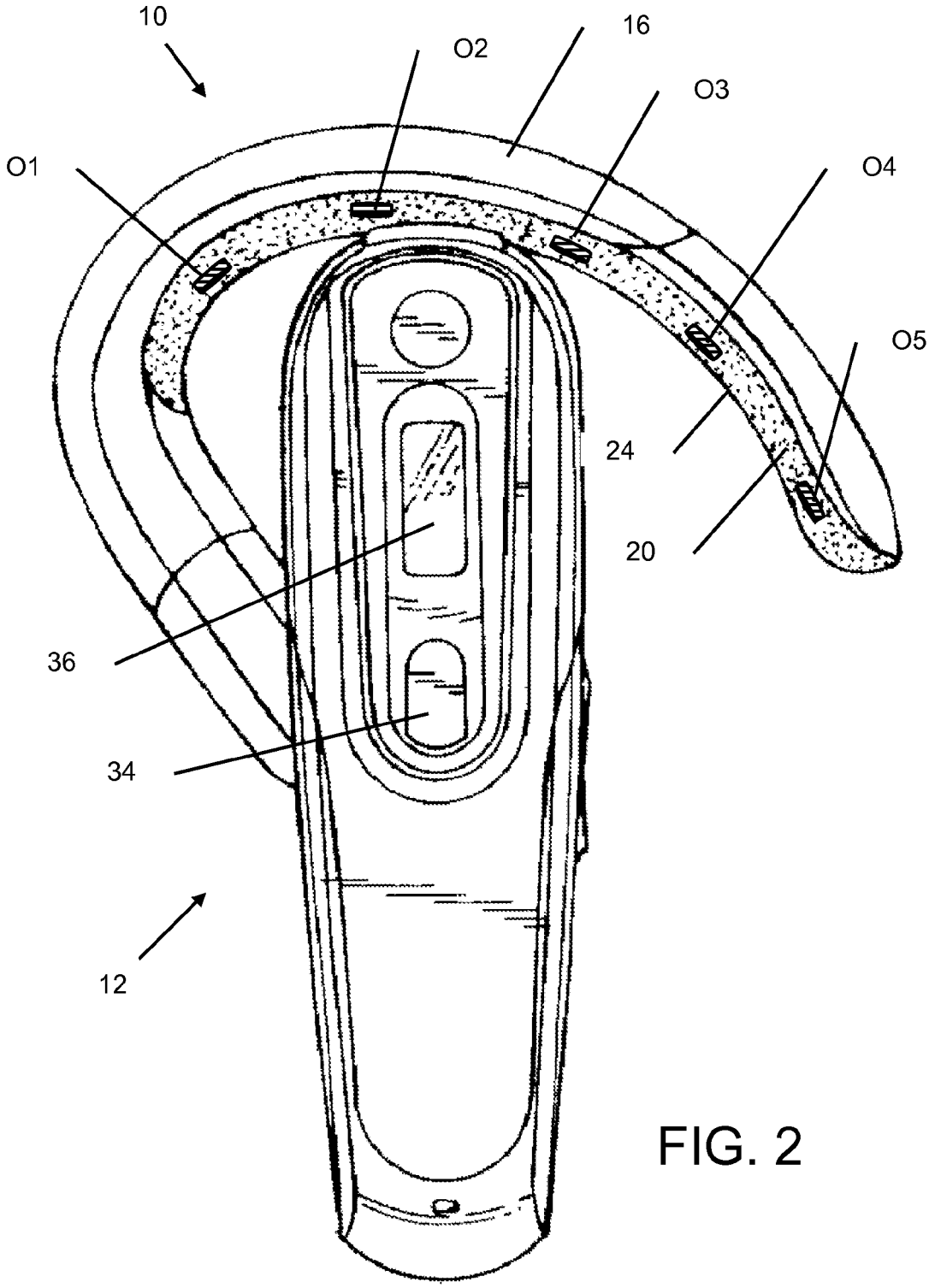
FIG. 2 is a rear view of the headset of FIG. 1.

Referring now to FIGS. 1 and 2, a headset 10 is shown in accordance with an exemplary embodiment of the invention. As is conventional, the headset 10 includes a body 12 configured to be affixed to the ear of the user when in use. In addition, the headset includes a speaker 14 for reproducing an audio signal provided from the portable electronic device (not shown). Further, the headset 10 includes a microphone 15 for producing a voice signal from the user. Again as conventional, the speaker 14 represents part of the body 12 such that when the body 12 is affixed to the ear, the speaker 14 is positioned proximate the ear canal of the user. Similarly, the microphone 15 is positioned proximate the mouth of the user.

In accordance with the present invention, the headset 10 includes at least one sensor for producing an output indicative of whether the body 12 is affixed to the ear of the user. For example, the body 12 in the exemplary embodiment includes a semicircular portion 16 configured to wrap around the pinna when affixing the body 12 to the ear of the user. The semicircular portion 16 includes a plurality of sensors I1-I6 located along an inner wall 18 of the semicircular portion 16. The inner wall 18 represents a section of the semicircular portion 16 most likely to come into contact with the ear and/or head (skull) of the user when the headset 10 is affixed to the ear.

Similarly, the semicircular portion 16 includes a plurality of sensors O1-O5 located along an outer wall 20. The outer wall 20 represents a section of the semicircular portion 16 most likely to come into contact with the side of the ear flap closest to the head of the user when the headset 10 is affixed to the ear.

Further, the speaker 14 in the exemplary embodiment is located in a bud portion 22 of the body 12 designed to be inserted in the concha when affixed to the ear of the user. The bud portion 22 includes additional sensors B1-B4 positioned so as to come into contact with the ear of the user when the bud portion 22 has been inserted in the concha.

In another embodiment, the semicircular portion 16 may include sensor(s) along the edge 24 in addition to or in place of the sensors along the inner wall 18 and/or outer wall 20. Of course, the objective is to locate the sensors on the headset 10 at positions where the sensors are most likely to contact the ear and/or head of the user when the headset is affixed to the ear of the user. Since the body 12 of the headset 10 can take on many shapes and sizes, the invention is not intended to be limited to the specific location(s) of the sensor(s) in its broadest sense.

In the exemplary embodiment, the various sensors I1-I6, O1-O5 and B1-B4 are each represented by a capacitive sensor designed to detect when the sensor has come into contact with the head and/or ear of the user. Capacitive sensors suitable for such operation are well known, and thus further detail is omitted herein for sake of brevity. Additionally, or in the alternative, other types of sensors may be utilized. For example, another embodiment may employ optical sensors and/or miniature mechanical sensors designed to detect when the sensor is in contact with the head or ear of the user as a result of the headset 10 being affixed to the ear of the user.

It is desirable that the headset 10 be able to distinguish between being mounted on the ear of the user versus incidental contact. For instance, with a single sensor, contact with a finger or hand carrying the headset 10 can result in a false positive indication of the headset 10 being affixed to the ear. Similarly, in a case where the headset 10 is carried in the pocket of the user, or on a chain around the neck of the user, incidental contact with something other than the ear or head can result in the headset 10 ascertaining incorrectly that it is mounted to the ear of the user.

Accordingly, the headset 10 includes an on-ear analyzer as discussed below in more detail. In the exemplary embodiment, the on-ear analyzer is operatively coupled to the respective outputs of multiple sensors I1-I6, O1-O5, B1-B4. By analyzing the outputs of the multiple sensors, the headset 10 can better distinguish between the body 12 being affixed to the ear of the user versus incidental contact with a given sensor. As exemplified herein, the on-ear analyzer may be configured to apply various rules or profiles associated with the outputs of the respective sensors in order to distinguish between the two.

For instance, in the embodiment of FIGS. 1 and 2, the sensors B1-B4 are distributed about the circumference of the bud portion 22. Thus, the greater the number of the sensors B1-B4 sensing contact at a given time, the more likely the headset 10 is affixed to the ear as compared to merely experiencing incidental contact with a pocket, hand, etc. Similarly, the greater the number of the sensors I1-I6 and O1-O5 sensing contact at a given time, the more likely the headset 10 is affixed to the ear rather than incurring incidental contact.

It is desirable to manufacture and sell a headset 10 suitable for any number of users. However, the shapes, sizes, etc. of peoples ears vary. Thus, it is not necessarily the case that all of the sensors (e.g., B1-B4, I1-I6 and O1-O5) will sense contact even when the headset 10 is mounted to the ear. Depending on the shape or size of the ear of the particular user, the particular spacing between the inner side of the earflap and the skull of the user, etc., it is possible that only some of the sensors will sense contact.

Accordingly, the on-ear analyzer applies one or more rules or profiles to the outputs of the sensors. As is discussed in more detail below in relation to FIGS. 5 and 6, the rules or profiles are selected to distinguish better between contact resulting from being mounted to the ear versus incidental contact.

In the exemplary embodiment, the sensors are divided nominally into subsets. For example, the multiple sensors on the semicircular portion 16 may be divided into a first subset of sensors (e.g., I1-I3 and O1-O2) located proximate the fixed end of the semicircular portion 16, and a second subset of sensors (e.g., I4-I6 and O3-O5) located proximate the distal end. The sensors B1-B4 on the bud portion 22 may represent a third subset. The rules may be structured such that the on-ear analyzer requires at least a predetermined number of the sensors in each subset to detect contact in order to conclude that the body 12 is affixed to the ear.

Still further, the on-ear analyzer according to the exemplary embodiment includes a learning function configured to detect the output of each of the sensors while the body is affixed to the ear of a given user. The on-ear analyzer in turn stores the outputs in memory so as to represent a profile for the particular user. Since ears vary in size, shape, etc., the profiles stored in memory enable the headset 10 to identify the particular user of the headset 10. More specifically, the on-ear analyzer may subsequently determine which particular user is using the headset 10 based on a comparison of the outputs of each of the sensors with the profiles stored in memory. Consequently, the headset 10 can cause the headset itself or the device with which the headset communicates to automatically configure itself for use in accordance with the preferences, settings, etc. associated with the particular user.

Figure 3:
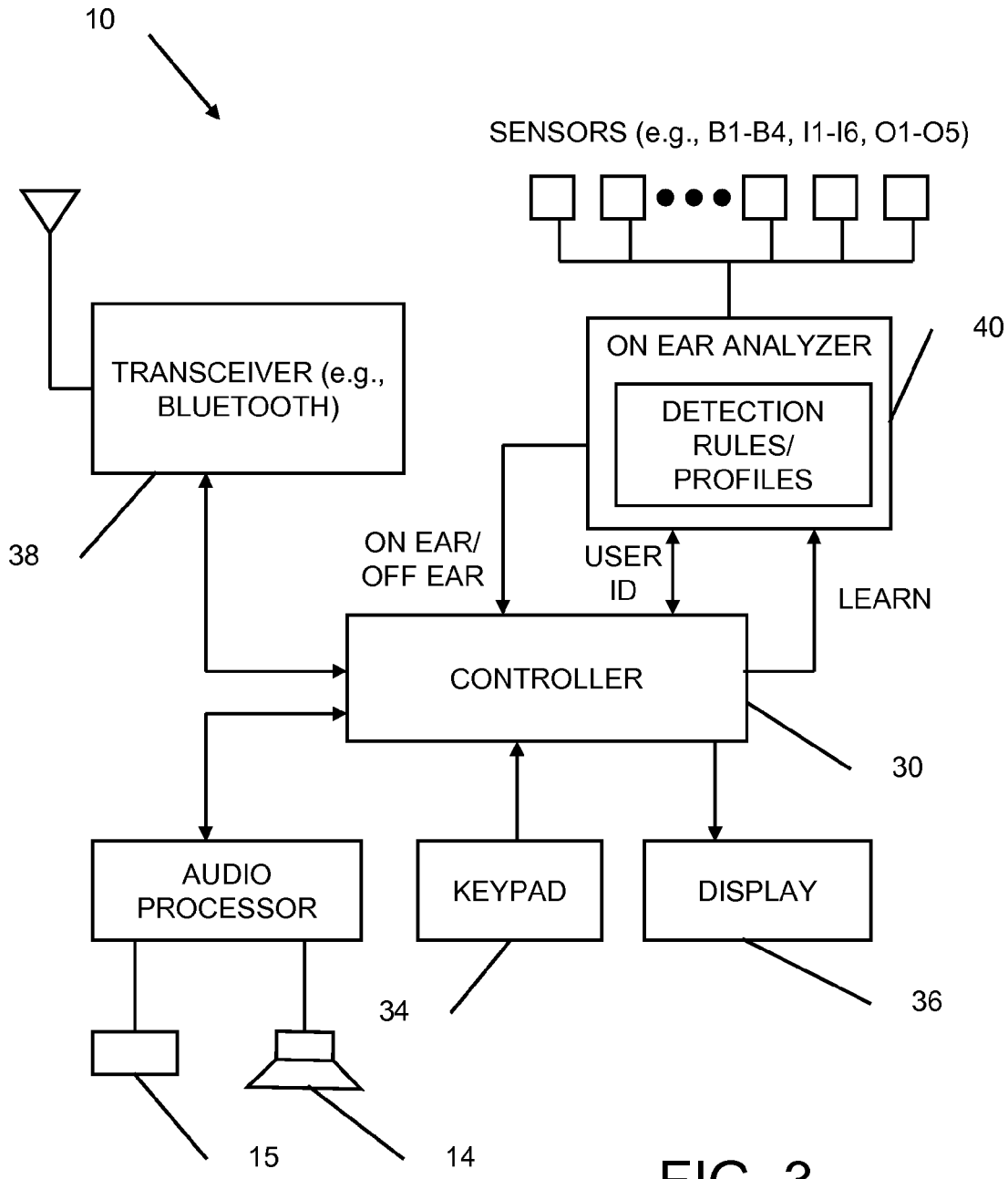
FIG. 3 is a block diagram of a headset with on-ear detection in accordance with an exemplary embodiment of the present invention.

Referring now to FIG. 3, a block diagram of the headset 10 is shown. As is conventional, the headset 10 includes a processor or controller 30 programmed to carry out conventional headset operations as well as overall control as described herein. The headset 10 also includes an audio processor 32 for processing the signals to/from the speaker 14 and microphone 15, a keypad 34 for user input, and a display 36, as are also conventional. Furthermore, in the exemplary embodiment the headset 10 is a wireless headset. The headset 10 includes a Bluetooth or other type wireless transceiver 38 for communicating with a mobile phone or other portable electronic device as discussed above.

Figure 4:
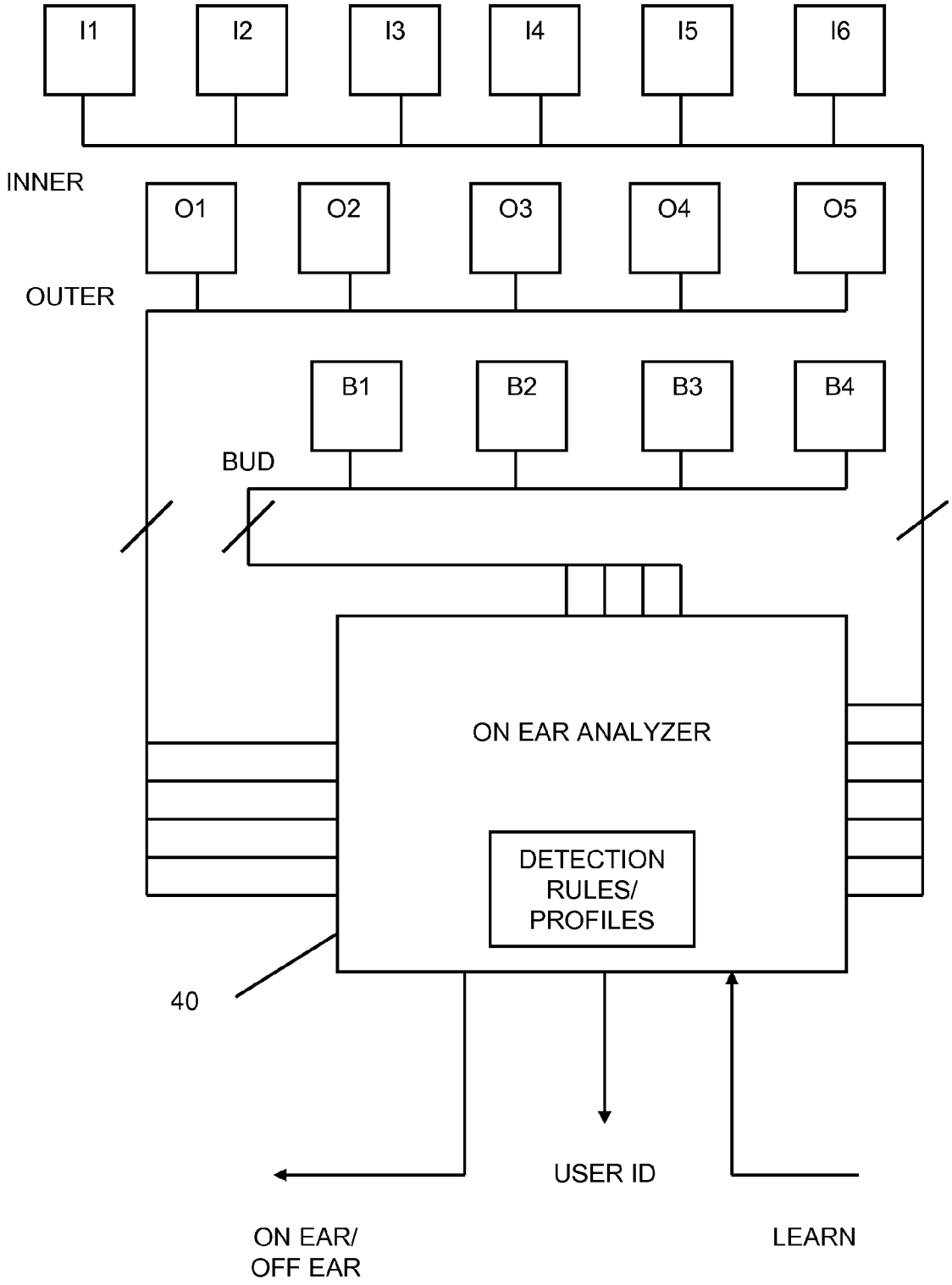
FIG. 4 is a detailed block diagram of the on-ear detection function in accordance with an exemplary embodiment of the present invention.

In accordance with the present invention, the headset 10 includes the aforementioned on-ear analyzer 40, shown in more detail in relation to the sensors in FIG. 4. The on-ear analyzer 40 may be made up of a discrete processor, hardware, firmware, software, or any combination thereof as will be appreciated. The analyzer 40 may in fact be incorporated within the controller 30 itself as will be further appreciated. The on-ear analyzer 40 receives the outputs of each of the sensors B1-B4, I1-I6 and O1-O5. By applying one or more rules or profiles to the respective sensor outputs as discussed above, the analyzer 40 concludes whether the headset 10 is affixed to the ear of a user. Based on its analysis, the analyzer 40 provides an on-ear/off-ear control signal to the controller 30. Depending on the particular application of the present invention, such an on-ear/off-ear control signal may be used to initiate or carry out respective functions (e.g., wake from sleep mode, initiate connection with another Bluetooth device, etc.).

A user wearing the headset 10 may prompt the analyzer 40 to learn the profile associated with the user by pressing a "learn" button (not shown) on the keypad 34 and by entering user identification information. Upon the "learn" button being pressed, the analyzer 40 samples and stores the outputs of the respective sensors B1-B4, I1-I6 and O1-O5, thus creating a profile associated with the particular user. When the headset 10 is subsequently mounted to the ear of a user, the on-ear analyzer 40 compares the current profile obtained by the sensors with the profiles previously stored in the analyzer 40. In the event the current profile matches a profile stored in the analyzer 40, the analyzer 40 provides a user identification signal to the controller 30. The controller 30 may then carry out any user specific operations, thus further facilitating ease of use for a given user.

FIG. 5 illustrates exemplary rules the on-ear analyzer 40 may apply in order to determine whether the body 12 is affixed to the ear. Such rules are by no means intended to be exhaustive, and are merely presented as example. According to rule (a), if at least two of bud sensors B1-B4, at least two of inner sensors I1-I6 and at least two of outer sensors O1-O5 indicate that the body is affixed to the ear, the on-ear analyzer 40 determines that the body 10 is in fact affixed to the ear and provides an on-ear signal to the controller 30. According to rule (b), if at least two of bud sensors B1-B4, at least two of inner sensors I4-I6 or outer sensors O3-O5, and at least two of inner sensors I1-I3 or outer sensors O1-O2 indicate the body 10 is affixed to the ear, the on-ear analyzer 40 determines that the body 10 is in fact affixed to the ear and provides an on-ear signal to the controller 30. As will be appreciated, the rules preferably are developed based on a priori knowledge of the position of the various sensors and the characteristics of the human ear. The invention is not limited to any particular rules in its broadest sense.

FIG. 6 illustrates exemplary profiles learned by the on-ear analyzer. For example, profile 1 (corresponding to "Bob") constitutes sensors B1, B3, B4, I1, I2, I5, O2, O3 and O5 indicating contact out of all the sensors. Similarly, profile 2 (corresponding to "Sally") constitutes sensors B2, B3, I2, I4, I5, O1, O2 and O5 indicating contact out of all the sensors. Profile 3 represents yet another profile, in this case for "Fred". Thus, if a user (e.g., "Sally") randomly utilizes the headset 10 by mounting the headset to her ear, the on-ear analyzer 40 will compare the current profile obtained from the outputs of the sensors with the profiles stored therein. The on-ear analyzer 40 will thus detect that the headset 10 is mounted on the ear of the user, and that the user is "Sally". The on-ear analyzer 40 may consequently provide such information to the controller 30 as described herein.

Figure 7:
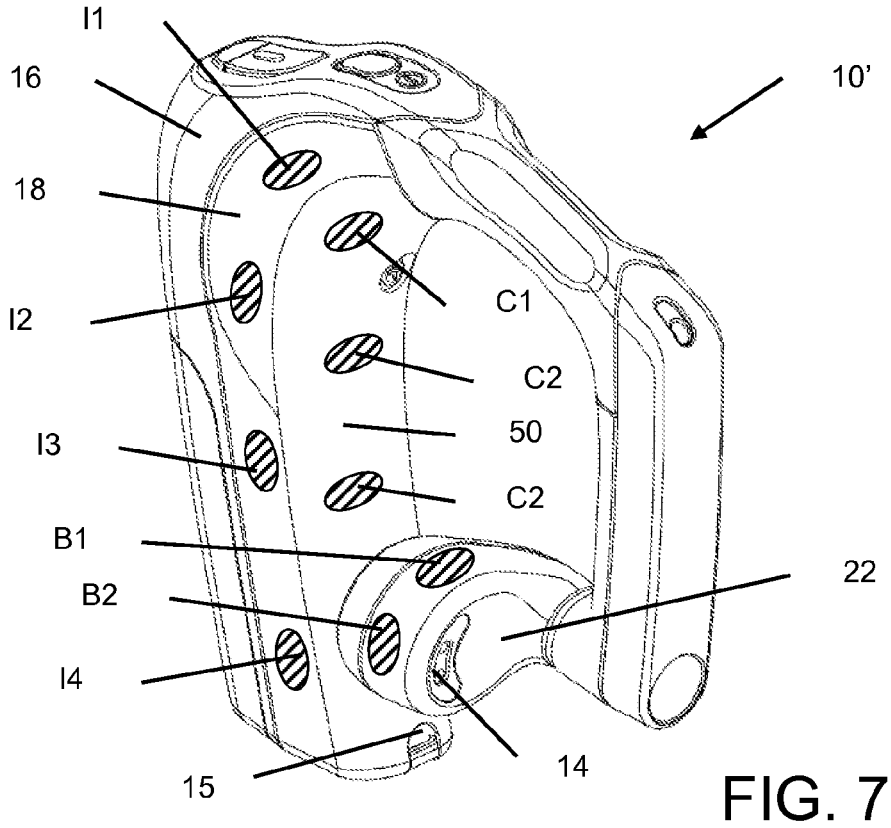
FIG. 7 is a perspective view of a headset with on-ear detection in accordance with another exemplary embodiment of the present invention.
Figure 8:
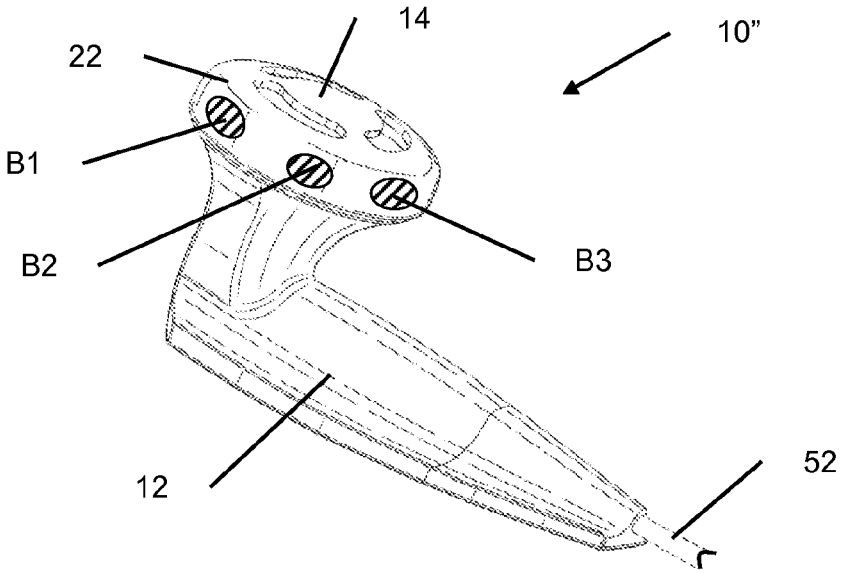
FIG. 8 is a perspective view of a headset with on-ear detection in accordance with another exemplary embodiment of the present invention.

FIGS. 7 and 8 illustrate two more examples of headsets incorporating the features of the invention. As will be appreciated, the headset of the present invention can be of virtually any shape, size and/or type of headset. For example, FIG. 7 illustrates a headset 10' having what is referred to as a "G-shaped" body 12. The inner wall 18 of the semicircular portion 16 includes sensors I1-I4. In addition, in this particular embodiment the semicircular portion 16 includes a broad face 50 in which sensors C1-C3 are located, for example. Still further, the bud portion 22 may include sensors B1 and B2, for example.

FIG. 8 illustrates an earbud style headset 10". Similar to the previous embodiments, the bud portion 22 includes sensors B1-B3. In this particular embodiment, the headset 10" is shown as a wired type headset having a wire 52 which connects the headset 10" to a corresponding electronic device. It will be appreciated that any of the embodiments discussed herein could be either wired or wireless type headsets without departing from the scope of the invention.

As in the embodiment of FIGS. 1 and 2, the headsets of FIGS. 7 and 8 include the one or more sensors configured to produce an output indicative of whether the body 12 is affixed to the ear. The outputs of the various sensors may then be analyzed in the same manner described above in relation to FIGS. 3-6. Thus, further detail is omitted for sake of brevity.

In view of the above, those having ordinary skill in the art will appreciate that the headset in accordance with the present invention offers both enhanced functionality and/or ease of use for the user.

The term "electronic device" as referred to herein includes portable radio communication equipment. The term "portable radio communication equipment", also referred to herein as a "mobile radio terminal", includes all equipment such as mobile phones, pagers, communicators, e.g., electronic organizers, personal digital assistants (PDAs), smartphones or the like.

Although the invention has been shown and described with respect to certain preferred embodiments, it is obvious that equivalents and modifications will occur to others skilled in the art upon the reading and understanding of the specification. The present invention includes all such equivalents and modifications, and is limited only by the scope of the following claims.

The invention claimed is:

1. A headset, comprising:

a body configured to be affixed to an ear of a user;

a speaker for reproducing an audio signal, the speaker representing part of the body such that when the body is affixed to the ear, the speaker is positioned proximate the ear canal of the user;

two or more sensors for producing respective sensor outputs indicative of whether the body is affixed to the ear; and an analyzer, operatively coupled to a plurality of the two or more sensors, and configured to compare the respective outputs of the plurality of sensors with at least one of a known output pattern comprising two or more sensor outputs that are characteristic of the body being affixed to the ear or a known output pattern comprising two or more sensor outputs that are characteristic of incidental contact, and based on the comparison determine whether the body is affixed to the ear, thereby reducing the likelihood of false-positive readings incorrectly indicative of the body being affixed to the ear.

2. The headset of claim 1, further comprising a controller for controlling operation of the headset based on an output of the analyzer.

3. The headset of claim 1, wherein the plurality of sensors are positioned at different locations on the body.

4. The headset of claim 1, wherein the speaker is located in a bud portion of the body designed to be inserted in the concha when affixed to the ear, and at least one sensor of the plurality of sensors is located on the bud portion to detect when the bud portion has been inserted in the concha.

5. The headset of claim 4, wherein the at least one sensor comprises a plurality of bud portion sensors positioned at different locations on the bud portion.

6. The headset of claim 1, wherein the body comprises a semicircular portion configured to wrap around the pinna when affixing the body to the ear.

7. The headset of claim 6, wherein the plurality of sensors includes at least two sensors positioned at different locations along the semicircular portion.

8. The headset of claim 7, wherein the semicircular portion includes a fixed end and a distal end, and the plurality of sensors include sensors located proximate the fixed end and sensors located proximate the distal end.

9. The headset of claim 1, wherein the analyzer determines that the body is affixed to the ear if and only if the respective outputs of all of the sensors indicate that the body is affixed to the ear.

10. The headset of claim 1, wherein the plurality of sensors are represented by subsets, and the analyzer determines that the body is affixed to the ear if and only if at least one of the sensors in each subset indicate that the body is affixed to the ear.

11. The headset of claim 10, wherein the body comprises a semicircular portion configured to wrap around the pinna when affixing the body to the ear, the semicircular portion includes a fixed end and a distal end, and the plurality of sensors include a first subset of sensors located proximate the fixed end and a second subset of sensors located proximate the distal end.

12. The headset of claim 10, wherein the body comprises a semicircular portion configured to wrap around the pinna when affixing the body to the ear, the semicircular portion includes an inner side which faces the skull of the user and an outer side which faces the ear flap of the user when the body is affixed to the ear, and the plurality of sensors include a first subset of sensors located on the inner side and a second subset of sensors located on the outer side.

13. The headset of claim 1, wherein the headset comprises at least one of a wireless transceiver interface or a hardwire interface for connecting the headset to a source of the audio signal.

14. The headset of claim 1, further comprising a microphone for producing a voice signal from the user.

15. The headset of claim 1, wherein the plurality of sensors comprises at least one of a capacitive sensor, optical sensor, or mechanical sensor.

16. A headset, comprising:

a body configured to be affixed to an ear of a user;

a speaker for reproducing an audio signal, the speaker representing part of the body such that when the body is affixed to the ear, the speaker is positioned proximate the ear canal of the user;

a plurality of sensors for producing respective outputs positioned at different locations on the body; and an analyzer configured to detect the respective outputs of each of the sensors while the body is affixed to the ear of the user, and to store the outputs in memory so as to represent an identification profile for the user, and the analyzer configured to analyze whether the body is affixed to the ear of the user based on a comparison of the respective outputs of each of the sensors with the identification profile stored in memory.

17. The headset of claim 16, wherein the analyzer is configured to learn and to store the identification profiles of each of a plurality of different users, and subsequently to analyze whether the body is affixed to the ear of a user, and if so, to which user, based on a comparison of the respective outputs of each of the sensors and the identification profiles stored in memory.

18. The headset of claim 17, further comprising a controller for controlling operation of the headset based on an output of the analyzer, at least one aspect of the control being a function of the particular user's ear to which the analyzer determines the body to be affixed.

19. The headset of claim 18, wherein the at least one aspect of the control comprises one or more user specific operation preferences.

* * * * *